United States Patent [19]

Vercillo et al.

[11] Patent Number: 4,574,669

[45] Date of Patent: Mar. 11, 1986

[54] AUTOMATIC PUNCH

[75] Inventors: Alfredo J. Vercillo, Harwood Heights; Roger M. Scharer, Des Plaines, both of Ill.

[73] Assignee: General Binding Corporation, Northbrook, Ill.

[21] Appl. No.: 610,482

[22] Filed: May 15, 1984

[51] Int. Cl.[4] ..... B26F 1/02

[52] U.S. Cl. ..... 83/399; 83/62; 83/522; 83/526; 234/33

[58] Field of Search ..... 83/58, 62, 399, 400, 83/524, 526, 522, 620, 622; 234/33, 34

[56] References Cited

U.S. PATENT DOCUMENTS 3,227,023 1/1966 Bouvier ..... 83/622 X 3,430,529 3/1969 McMonagle ..... 234/33 X 4,000,673 1/1977 Lyon ..... 83/620 X

*Primary Examiner*—James M. Meister

*Attorney, Agent, or Firm*—Hill, Van Santen, Steadman & Simpson

[57] ABSTRACT

A power sheet punching apparatus is provided in which a reversing drive operates initially to drive punches through a stack of sheets and thereafter to reverse direction of the drive to withdraw the punches from the sheets. Should the drive be insufficient to drive the punches through the sheets and a jam occurs, an automatic timer operates to thereafter stop the drive and reverse the drive to withdraw the punches from the sheets, thereby providing an automatic non-jamming punch mechanism.

6 Claims, 3 Drawing Figures

AUTOMATIC PUNCH

BACKGROUND OF THE INVENTION

Electric power punches for providing a plurality of apertures along one edge of pages to be bound in a looseleaf binder, have been manufactured for many years. They were principally developed to overcome the extremely large forces required to punch a significant number of sheets of paper simultaneously. The punching of typical paper stock in lifts containing more than ten or twelve sheets requires heavy duty mechanical and electrical equipment, while the construction of power punches able to handle lifts of more than twenty sheets are extremely heavy duty and expensive mechanisms.

In view of the large loads required to punch increasingly thick lifts of paper stock, electric punches are typically designed with a lift opening capable of accepting only a thickness which can be successfully punched by the particular machine. From an operator's point of view, such a limited lift opening makes operation of the punch difficult since the rapid insertion of a lift of sheets into the opening is difficult when the opening is the same or only slightly wider than the lift itself. On the other hand, if the lift opening is made substantially larger than the thickness of the maximum punchable lift, the tendency is for the punch operator to insert a larger lift than can be punched by the power system. The result of an excessively thick lift being inserted in the opening is a jam situation wherein the punch does not completely pierce the entire lift and the mechanism is stuck in its jammed condition. While manually operable reversing mechanisms have been employed to reverse the punch after jamming, to our knowledge no prior art system has devised an automatic mechanism by which a jammed machine is prevented.

SUMMARY OF THE INVENTION

In accordance with the principles of the present invention, a power punch mechanism, preferably designed to punch a large number of closely spaced rectangular apertures adjacent the paper edge, is electrically powered by a reversible motor drive. Initiation of the forward direction of rotation, which drives the punches through the paper is accomplished by a manual switch which energizes a control circuit. The control circuit incorporates a sequencing and timer mechanism which initially causes the punch motor to drive in the forward direction. In the normal circumstance, the punch elements will pass through the lift at which time their position sensed, the motor is deenergized, a brake is applied to the punch drive shaft for a moment, and the motor is then driven in reverse direction until the punches return to the at-rest, or home, position to complete a punching cycle. As may happen, the punch may not completely pierce the pages of the lift as above indicated. In such a case, the control circuit pauses for a brief timed beyond the time normally taken for piercing the lift, and upon the completion of that time lapse, the motor is deactivated, the brake is applied momentarily, and the reverse windings of the motor are energized to return the punch to its at-rest or home state. At this point the operator may manually restart the machine to try again to fully pierce the unduly thick lift, or alternatively, he may divide the lift into two portions and punch each separately. In either case, the machine has automatically reversed itself to remove the punches from the lift and to thereby prevent any actual jammed condition of the machine in which the punches are stuck in the lift.

As a result of the above-described arrangement, a slightly larger lift opening may be employed to provide an ease of lift insertion, without continually causing a jam that is difficult to remove. Further, because of the automatic action of the machine, the overall machine may be manufactured smaller than would be otherwise required to withstand jams typically caused by oversized lifts in prior art devices.

It is, accordingly, an object of the present invention to provide an automatically operating power punch which provides a positive reverse drive actuation without operator assistance.

It is a further object of the invention to provide a convenient power punch having a lift opening slightly larger than the maximum lift thickness it is capable of punching so that loading the punch is a simple and fast operation.

IN THE DRAWINGS

DESCRIPTION OF THE INVENTION

Figure 1:
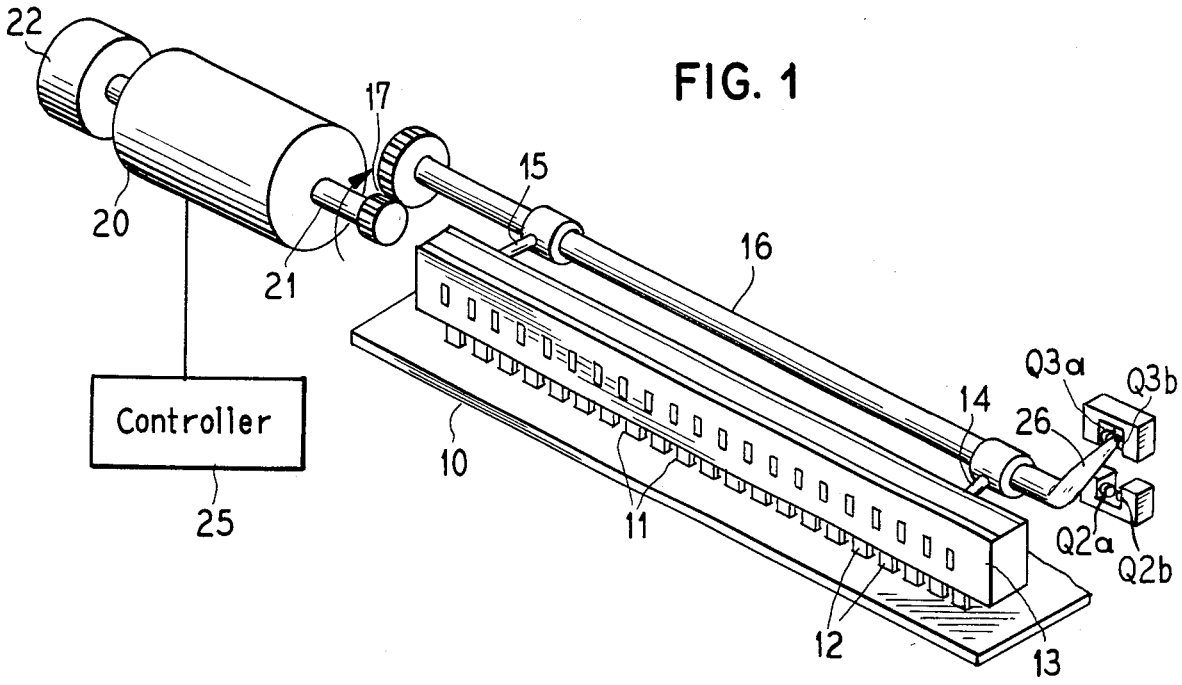
FIG. 1 is an isometric and schematic illustration of the automatic punch constructed in accordance with the present invention.

The paper punching mechanism of the invention may desirably take the form illustrated in prior U.S. Pat. No. 3,227,023. As there shown, an oscillating punch drive shaft successively and sequentially operates a plurality of punch pins by a pair of spaced radially extending actuator elements that are angularly offset with respect to each other to effect operation of the punched pin pressure bar from one end toward the other. In the schematic illustration of FIG. 1, the punch comprises a pierced die member 10 having a plurality of apertures 11 through which punch pins 12 are driven by a pressure bar 13 which is driven downwardly, and then upwardly, by actuating elements 14 and 15 carried by the punch drive shaft 16. The punch drive shaft 16 is driven by a reduction gear transmission 17 driven by a motor 20 which is of a conventional split phase capacitor run type such as, for example, marketed by Von Weise. The output shaft 21 of the motor 20 carries a brake 22 which will, as described below, be engaged prior to reverse actuation of the motor in either normal or jam type operation.

Figure 2:
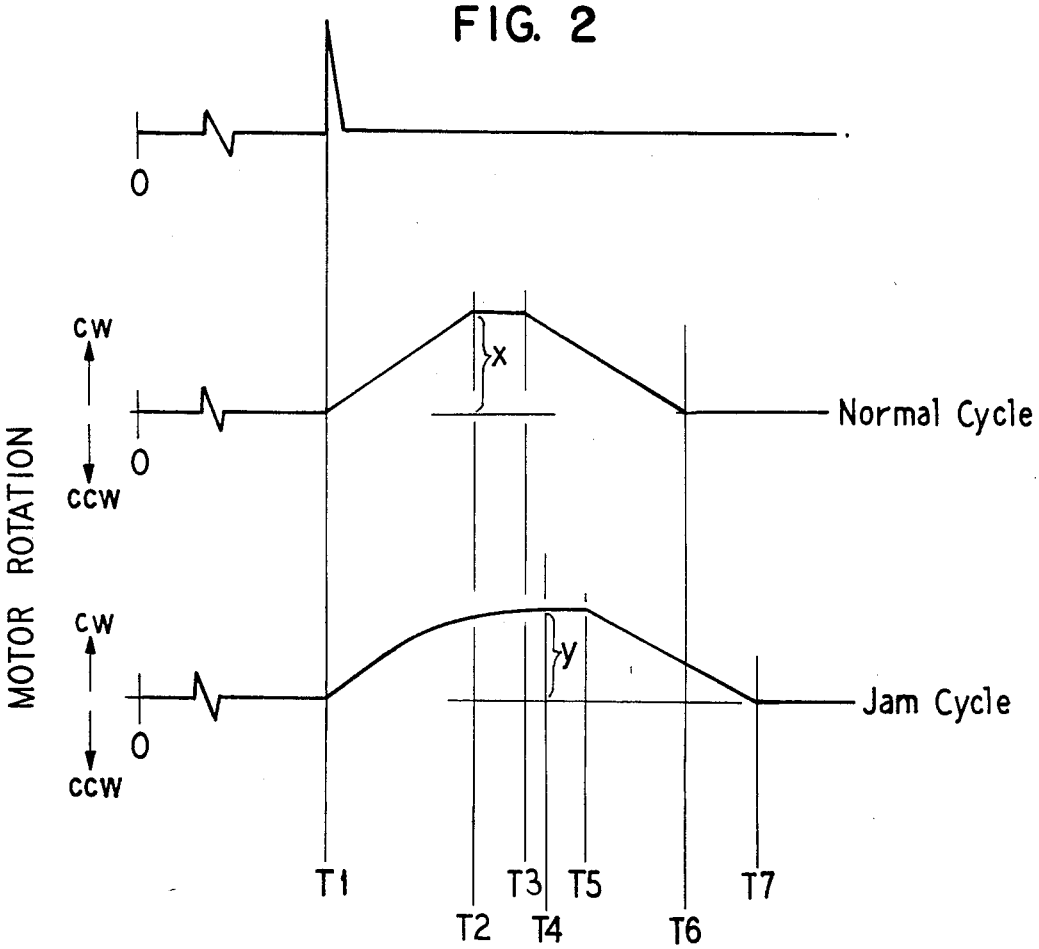
FIG. 2 is a timing diagram illustrating the difference between a non-jam normal cycle, and a jam cycle as they occur in the punch of the present invention.

Functionally, the system can be understood from a consideration of FIG. 2. As there shown, both normal and jam cycles are shown for comparison. In the normal cycle the motor 20 operates in the clockwise (CW) mode in the direction for driving the punches downwardly to punch the paper. Counterclockwise rotation operates, conversely, to positively withdraw the punches from the paper. Accordingly, upon the application of a trigger pulse, which occurs upon a manual switch application, the motor is, in a normal cycle, driven clockwise during a time time period T1 to T2 through a distance sufficient to drive the pins completely through the lift of paper, which distance is shown as X in FIG. 2. Upon passage of the pins through the lift, the motor is deenergized and a brake momentarily applied during the period T2 through T3. At this time the motor is reversed and driven counterclockwise during the period from T3 through T6 to the at-rest condition, at which it remains until again supplied with a manual trigger pulse.

As shown in the lower portion of FIG. 2, a jam cycle provides a somewhat different sequence of operation. As there shown, upon the application of the trigger pulse, the motor rotates in the clockwise direction, but achieves only a distance Y, insufficient to penetrate the complete lift of paper, even though the time extends beyond T2. In the jam situation, after completion of T4, even without completion of the punching of the lift, the motor is deenergized and the brake actuated during the time period T4 to T5. Following this point in the operation, the motor is energized in the reverse, or counterclockwise direction at T5 and returns the system to the at-rest condition upon the completion of the time T7. From the at-rest condition, the punch may be reenergized by a new trigger pulse, in which case, the motor tries to complete the piercing operation in a recycling manner. The manual trigger may be pulsed as many times as desired in an effort to complete the punch. However, in practice, it is preferred that having recognized a jam condition, by virtue of the fact that the lift has not been completely pierced, the operator will divide the lift into two parts which may be recycled separately. Upon using the punch for a very short period of time, the usual operator has no difficulty in sensing the proper lift size to allow non-jamming, normal, cycling, even though that lift size is substantially less than the lift opening provided in the punch.

Figure 3:
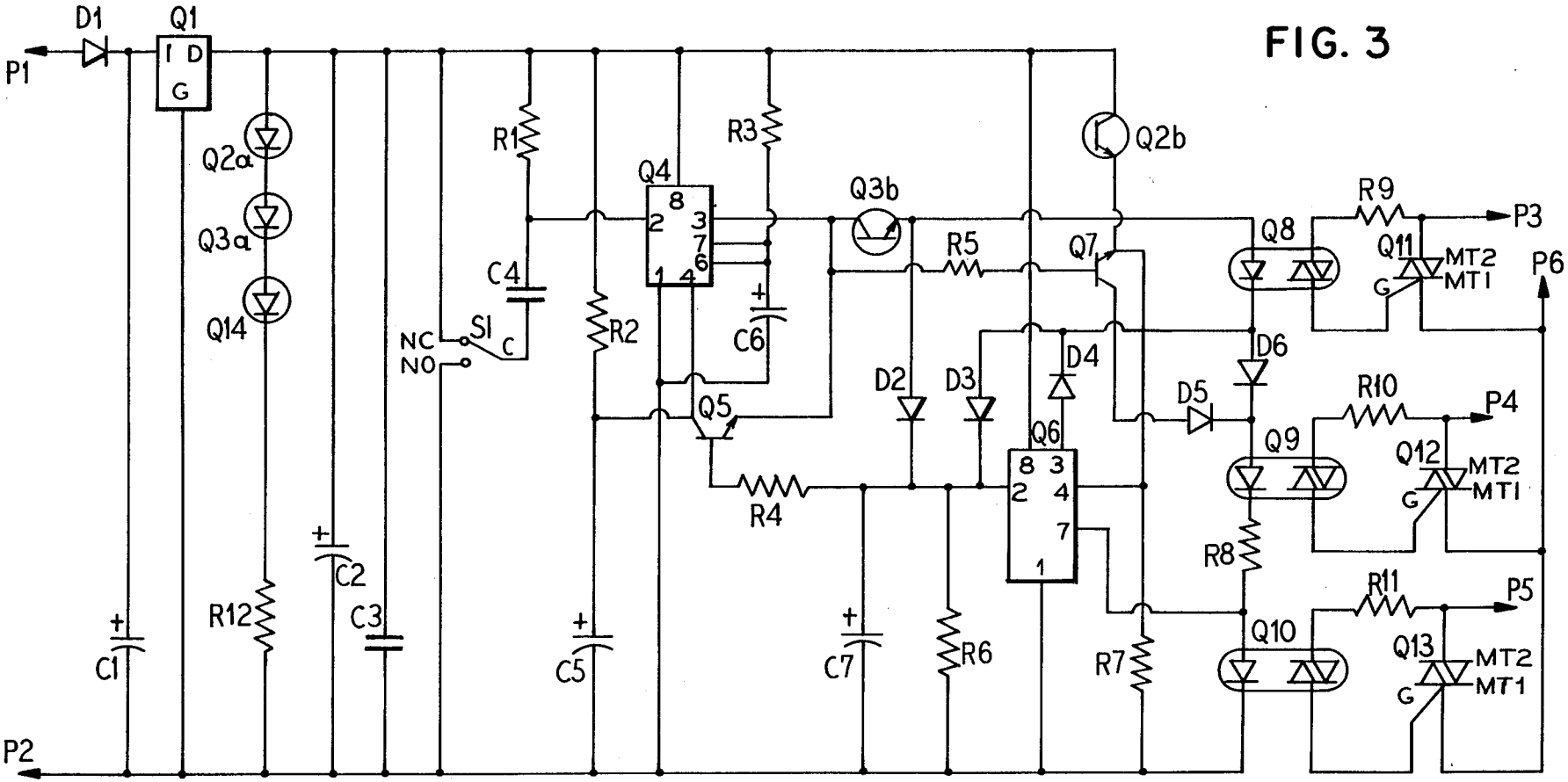
FIG. 3 is a circuit diagram arranged to provide for actuation of the punch motor, a braking mechanism, and peripheral controls.

Control of the motor and the brake is accomplished by way of an electrical controller indicated at 25 in FIG. 1. The controller 25, which is shown in schematic detail in FIG. 3, provides, as there shown, a power source, typically 15 volt alternating current at P1 , P2. Photon coupled interrupter mechanisms, such as for example, General Electric Part No. H2 2 B3, are provided for detecting the position of the punch drive shaft 16. As shown in FIG. 1, the shaft 16 drives a flag element 26 between an upper position in which the punch has completed punching of the lift, and the at-home position, in which the punches have moved upwardly to their maximum, at-rest condition in which the lift opening of the punch is open for insertion of a new lift of paper to be punched. In the drawing the Photon coupled interrupter mechanisms include a light-emitting diode Q2*a* which energizes the switch Q2*b* to disconnect operation of the motor reversing circuit upon achievement of the at-rest, home, condition. Similarly, the Photon coupled interrupter combination Q3*a* and Q3*b* operate to terminate operation of the forward motor energization when the flag 26 reaches the punch complete position, as shown in FIG. 1.

In the circuit shown in FIG. 3, Q14 comprises a light-emitting diode providing illumination for the switch S1 which may be pulsed by momentary closure to trigger a timer element which may, for example, comprise an R.C.A. Part No. CA 555-CE.

The timer Q4 starts, with current flowing through Q3*b* energizing the diode actuated triac Q8 energizing the forward direction motor windings via triac Q11. The optical coupled triacs Q8, Q9, and Q10 may comprise Optron Part Nos. OPI 3022 and the triacs Q11 and Q13 may comprise Teccor Part Nos. Q601025. Similarly, the triac Q12 may comprise a Teccor Part No. Q600424. Upon the initial operation of the switch S1, above described, current is supplied via Q3*b* to the optical coupled triac Q8 and the optical coupled triac Q9 which, when thus energized, energizes a brake release mechanism removing brake force from the shaft 21 to permit rotation of the shaft while the motor is energized in the forward direction. At this time, current flowing through R8 is diverted to a momentary ground at terminal 7 of the second timer Q6, so that the optical coupled triac Q10 is not energized. When the Photon coupled interrupter Q3B is interrupted by movement of the flag 26, following completion of the punching stroke, the circuit is interrupted and Q8 and Q9 are deenergized, with the result that the brake 22 is applied. Interruption of the circuit initiates timer Q6 which then, via terminal 3 energizes the optical coupled triacs Q9 and Q10, releasing the brake 22 and energizing the motor in the reverse direction, which reverse action is terminated when the Photo coupled interrupter Q2*b* is interrupted.

In the event of a jam situation, the Photon coupled interrupter Q3*b* is not interrupted, since the flag 26 never completely obscures the light emitting diode Q3*a*, In this event, the timer Q4 operates to interrupt the circuit powering Q8 and Q9 by interrupting current flow at time T4 shown in FIG. 2. This interruption operates, as in a normal cycle, to provide application of the brake and timed operation of the reverse motor optical coupled triac Q10. The circuit shown in FIG. 3 may, of course, be modified and is shown as a satisfactory embodiment only. Circuit values as there shown are as follows: R1, R2 are 100,000 ohms each; R3 is 470,000 ohms; R4 is 22,000 ohms; R5 is 10,000 ohms; R6 is 22,000 ohms; R7 is 1,000 ohms; R8 is 560 ohms; R9, R10, R11 are 100 ohms each and R12 is 220 ohms. Capacitances C1 and C2 are 100 microfarads each; C3 is 0.1 microfarad; C4 is 0.01 microfarad; C5 is 2.2 microfarads; C6 is 2.2 microfarads and C7 is 6.8 microfarads. The diodes D2, D3, D4, D5 and D6 may comprise part Nos. IN914 with D1 being for example, Part No. IN4002. The NPN transistor Q5 may comprise Part No. 2N4400 and the PNP transistor Q7 may, similarly, comprise Part No. 2N3905.

It will, of course, be obvious that different timer and motor controller elements may be used, and that depending upon the inertia characteristics of the motor and the transmission, the brake may be modified or eliminated. Accordingly, it is our intention that the scope of the present invention be limited by that of the appended claims only.

We claim as our invention:

1. Power sheet punching apparatus comprising motor means for rotating a punch drive shaft in a first direction of rotation to drive punch pins toward and through a lift of paper and in a reverse direction to withdraw the punch pins from the paper, first means responsive to manual actuation to start said motor in forward direction to initiate a punching cycle, flag means drivingly associated with said drive shaft and reflecting the instaneous position of the punch pins, first sensing means sensing the position of said flag means reflecting the condition of punch pins upon their passage completely through the paper, second means responsive to said first sensing means to stop forward energization of said motor, third means for thereupon energizing said motor to reverse direction to withdraw said pins to their at-rest home position, and fourth means bypassing said first sensing means to energize said third means to reverse said motor to return said pins to their rest position.

2. The apparatus of claim 1 including brake means for stopping said motor, means for applying said brake means upon operation of said second means, and means for releasing said brake means upon energization of said motor in either direction of rotation.

3. The structure set forth in claim 2 wherein said brake means is spring biased into the engaged, braking, condition, and is energized into released condition by energization of said motor.

4. The structure set forth in claim 1 wherein said fourth means comprises a timer operative upon passage of time in excess of the time taken between operation of said first means and normal energization of said first sensing means.

5. The structure of claim 4 including brake means for stopping said motor, means for applying said brake means upon operation of said second means, and means for releasing said brake means upon energization of said motor in either direction of rotation.

6. The structure of claim 4 wherein said brake means is spring biased into the engaged, braking, condition, and is energized into released condition by energization of said motor.

* * * * *